US011460053B2

(12) United States Patent
Slattery

(10) Patent No.: US 11,460,053 B2
(45) Date of Patent: Oct. 4, 2022

(54) OPEN CENTER CONTROL VALVE CONFIGURED TO COMBINE FLUID FLOW RECEIVED FROM MULTIPLE SOURCES

(71) Applicant: Parker-Hannifin Corporation, Cleveland, OH (US)

(72) Inventor: Brian B. Slattery, Hicksville, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 100 days.

(21) Appl. No.: 17/146,916

(22) Filed: Jan. 12, 2021

(65) Prior Publication Data

US 2021/0285553 A1 Sep. 16, 2021

Related U.S. Application Data

(60) Provisional application No. 62/990,072, filed on Mar. 16, 2020.

(51) Int. Cl.
*F15B 13/04* (2006.01)
*F15B 13/08* (2006.01)

(52) U.S. Cl.
CPC ..... *F15B 13/0402* (2013.01); *F15B 13/0871* (2013.01); *F15B 13/0814* (2013.01); *F15B 2211/20576* (2013.01); *F15B 2211/30505* (2013.01); *F15B 2211/30525* (2013.01); *F15B 2211/3116* (2013.01); *F15B 2211/3127* (2013.01); *F15B 2211/31582* (2013.01); *F15B 2211/329* (2013.01)

(58) Field of Classification Search
CPC ..... F15B 13/0402; F15B 13/0871; F15B 13/0433; F15B 13/0814; F15B 2211/20576; F15B 2211/30505; F15B 2211/30525; F15B 2211/3116; F15B 2211/3127; F15B 2211/31582; F15B 2211/329; F15B 2211/3133; F15B 2211/6355
See application file for complete search history.

(56) References Cited

U.S. PATENT DOCUMENTS 3,008,488 A * 11/1961 Vander Kaay ..... F15B 13/08 91/531
3,216,443 A * 11/1965 Schmiel ..... F15B 13/06 137/596.13
3,759,292 A * 9/1973 Bianchetta ..... E02F 9/2296 137/596
3,771,558 A 11/1973 Ailshie
3,785,156 A * 1/1974 Junck ..... F15B 11/17 60/471

(Continued)

*Primary Examiner* — Dustin T Nguyen
(74) *Attorney, Agent, or Firm* — McDonnell Boehnen Hulbert & Berghoff LLP

(57) ABSTRACT

An example valve housing comprises: a longitudinal bore; a first and second workport passages intercepting the longitudinal bore and configured to be fluidly coupled to an actuator; a first and second return cavities intercepting the longitudinal bore; a first inlet port configured to be fluidly coupled to a first source of fluid; a second inlet port configured to be fluidly coupled to a second source of fluid; an outlet port fluidly coupled to the first and second return cavities and configured to be fluidly coupled to a reservoir; a first dual-wing passage fluidly coupled to the first inlet port; a second dual-wing passage fluidly coupled to the second inlet port; and a third dual-wing passage fluidly coupled to the second inlet port.

20 Claims, 9 Drawing Sheets

(56) References Cited

U.S. PATENT DOCUMENTS

| | | | | |
|---|---|---|---|---|
| 6,408,876 | B1 * | 6/2002 | Nishimura | F16K 11/07 137/596.14 |
| 6,505,645 | B1 | 1/2003 | Pack et al. | |
| 7,631,591 | B2 | 12/2009 | Shelbourn et al. | |
| 8,316,757 | B2 | 11/2012 | Rinaldi | |
| 9,494,171 | B2 * | 11/2016 | Kobayashi | F16K 27/041 |
| 10,024,443 | B2 * | 7/2018 | Sensabaugh | F15B 13/021 |
| 10,323,659 | B2 * | 6/2019 | Slattery | F15B 13/0835 |
| 10,626,891 | B2 * | 4/2020 | Nishikawa | F15B 13/022 |
| 2019/0072115 | A1 | 3/2019 | Isogai | |

* cited by examiner

OPEN CENTER CONTROL VALVE CONFIGURED TO COMBINE FLUID FLOW RECEIVED FROM MULTIPLE SOURCES

CROSS REFERENCE TO RELATED APPLICATION

The present application claims priority to U.S. Provisional patent application No. 62/990,072 filed on Mar. 16, 2020, and entitled "Open Center Control Valve Configured to Combine Fluid Flow Received from Multiple Sources," the entire contents of which are herein incorporated by reference as if fully set forth in this description.

BACKGROUND

A multiple-spool control valve generally comprises a plurality of shiftable control spools controlling fluid flow to one or more hydraulic actuators of a hydraulic machine (e.g., a skid steer, excavator, wheel loader, backhoe, etc.). The valve can have sections are sandwiched between inlet and outlet end sections, or can have a monoblock, having ports connectable with a source of fluid and a low pressure reservoir.

Open-center type valve assemblies permit continuous open-center flow transversely through the valve assembly from the inlet to the outlet when all the spools are in neutral non-operative positions. Upon shifting a control spool to divert the fluid received from a source of fluid to actuate the associated actuator, the spool variably restricts or shuts off the open-center flow.

In examples, the hydraulic machine may have auxiliary or secondary actuators in addition to the primary actuators. It may be desirable to configure the open-center valve with an auxiliary valve section to control the auxiliary or secondary actuator of the machine. In some examples, it may be desirable to drive the auxiliary actuator with a higher fluid flow rate than what a primary source of fluid is capable of providing. As such, it may be desirable to be able to fluidly couple a secondary fluid flow source to the valve to provide additional flow.

To connect the secondary fluid flow source to the valve, an additional, separate mid-inlet valve section might be added to the valve to combine flow from both sources and provide it to the auxiliary section. Having an additional, separate valve section can increase cost and complexity of the valve assembly.

It is with respect to these and other considerations that the disclosure made herein is presented.

SUMMARY

The present disclosure describes implementations that relate to an open center control valve configured to combine fluid flow received from multiple sources.

In a first example implementation, the present disclosure describes a valve assembly having a valve housing comprising: (i) a longitudinal bore, (ii) a first and second workport passages intercepting the longitudinal bore and configured to be fluidly coupled to an actuator, (iii) a first and second return cavities intercepting the longitudinal bore, (iv) a first inlet port configured to be fluidly coupled to a first source of fluid, (v) a second inlet port configured to be fluidly coupled to a second source of fluid, (vi) an outlet port fluidly coupled to the first and second return cavities and configured to be fluidly coupled to a reservoir, (vii) a first dual-wing passage fluidly coupled to the first inlet port, (viii) a second dual-wing passage fluidly coupled to the second inlet port, and (ix) a third dual-wing passage fluidly coupled to the second inlet port. The valve assembly further includes a spool movable in the longitudinal bore to shift between: (i) a neutral position in which the spool allows fluid flowing through the first dual-wing passage to be combined with fluid flowing through the second dual-wing passage, then flow to the outlet port, and (ii) a shifted position in which the spool allows fluid in the first dual-wing passage to be combined with fluid in the third dual-wing passage, then flow to either the first or second workport passage while connecting the other workport passage to a corresponding return cavity of the first and second return cavities.

In a second example implementation, the present disclosure describes a hydraulic system comprising: a hydraulic actuator having a first chamber and a second chamber; a first source of fluid; a second source of fluid; a reservoir; and a valve assembly. The valve assembly comprises: a valve housing comprising: (i) a longitudinal bore, (ii) a first workport passage fluidly coupled to the first chamber and a second workport passage fluidly coupled to the second chamber, (iii) a first and second return cavities intercepting the longitudinal bore, (iv) a first inlet port fluidly coupled to the first source of fluid, (v) a second inlet port fluidly coupled to the second source of fluid, (vi) an outlet port fluidly coupled to the first and second return cavities and fluidly coupled to the reservoir, (vii) a first dual-wing passage fluidly coupled to the first inlet port, (viii) a second dual-wing passage fluidly coupled to the second inlet port, (ix) a third dual-wing passage fluidly coupled to the second inlet port. The valve assembly also comprises a spool movable in the longitudinal bore to shift between: (i) a neutral position in which the spool allows fluid flowing through the first dual-wing passage to be combined with fluid flowing through the second dual-wing passage, then flow to the outlet port, and (ii) a shifted position in which the spool allows fluid in the first dual-wing passage to be combined with fluid in the third dual-wing passage, then flow to either the first or second workport passage while connecting the other workport passage to a corresponding return cavity of the first and second return cavities.

In a third example implementation, the present disclosure describes a valve housing. The valve housing comprises: a plurality of longitudinal bores configured to receive respective spools configured to be axially-movable therein; a first inlet port configured to be fluidly coupled to a first source of fluid; a second inlet port configured to be fluidly coupled to a second source of fluid; an outlet port configured to be fluidly coupled to a reservoir; a plurality of workports configured to be fluidly coupled to respective hydraulic actuators; a first dual-wing passage fluidly coupled to the first inlet port; a second dual-wing passage fluidly coupled to the second inlet port; and a third dual-wing passage fluidly coupled to the second inlet port.

The foregoing summary is illustrative only and is not intended to be in any way limiting. In addition to the illustrative aspects, implementations, and features described above, further aspects, implementations, and features will become apparent by reference to the figures and the following detailed description.

BRIEF DESCRIPTION OF THE FIGURES

The novel features believed characteristic of the illustrative examples are set forth in the appended claims. The illustrative examples, however, as well as a preferred mode of use, further objectives and descriptions thereof, will best be understood by reference to the following detailed description of an illustrative example of the present disclosure when read in conjunction with the accompanying Figures.

DETAILED DESCRIPTION

An example valve can include several valve sections configured to control primary actuators of a machine (e.g., boom actuator and bucket actuator of a skid steer) and can also include an auxiliary valve section configured to control an auxiliary actuator for other or optional attachments of the machine. A source of constant fluid flow (e.g., a constant flow gear pump) can be configured provide fluid flow to the valve, and all flow goes through an open center path, then exits the valve through a tank port when the spools are in neutral (e.g., unactuated).

In some applications, it may be desirable to drive the auxiliary actuator at high speeds requiring more fluid flow rates than what the primary source can provide. In these applications, it may be desirable to configure the valve such that a second flow source (e.g., a second pump) can be fluidly coupled to the valve to provide additional fluid flow thereto. In conventional valves, an additional, separate valve section that can be referred to as a mid-inlet section can be added. The additional section combines fluid flow from both sources and provide it downstream through an open-center flow path. Such an arrangement, however, can increase valve cost and complexity.

Disclosed herein are systems, assemblies, and valves that, among other features, involve utilizing the auxiliary section to receive fluid flow from the second source of fluid, combine it with fluid flow from the first source, and provide it through the open-center path. This way, cost and complexity are reduced as an existing section is used rather than an additional section. Further, the disclosed valve accomplishes combining fluid flow in a way that keeps fluid flow forces on a spool of the auxiliary section consistent.

Figure 1:
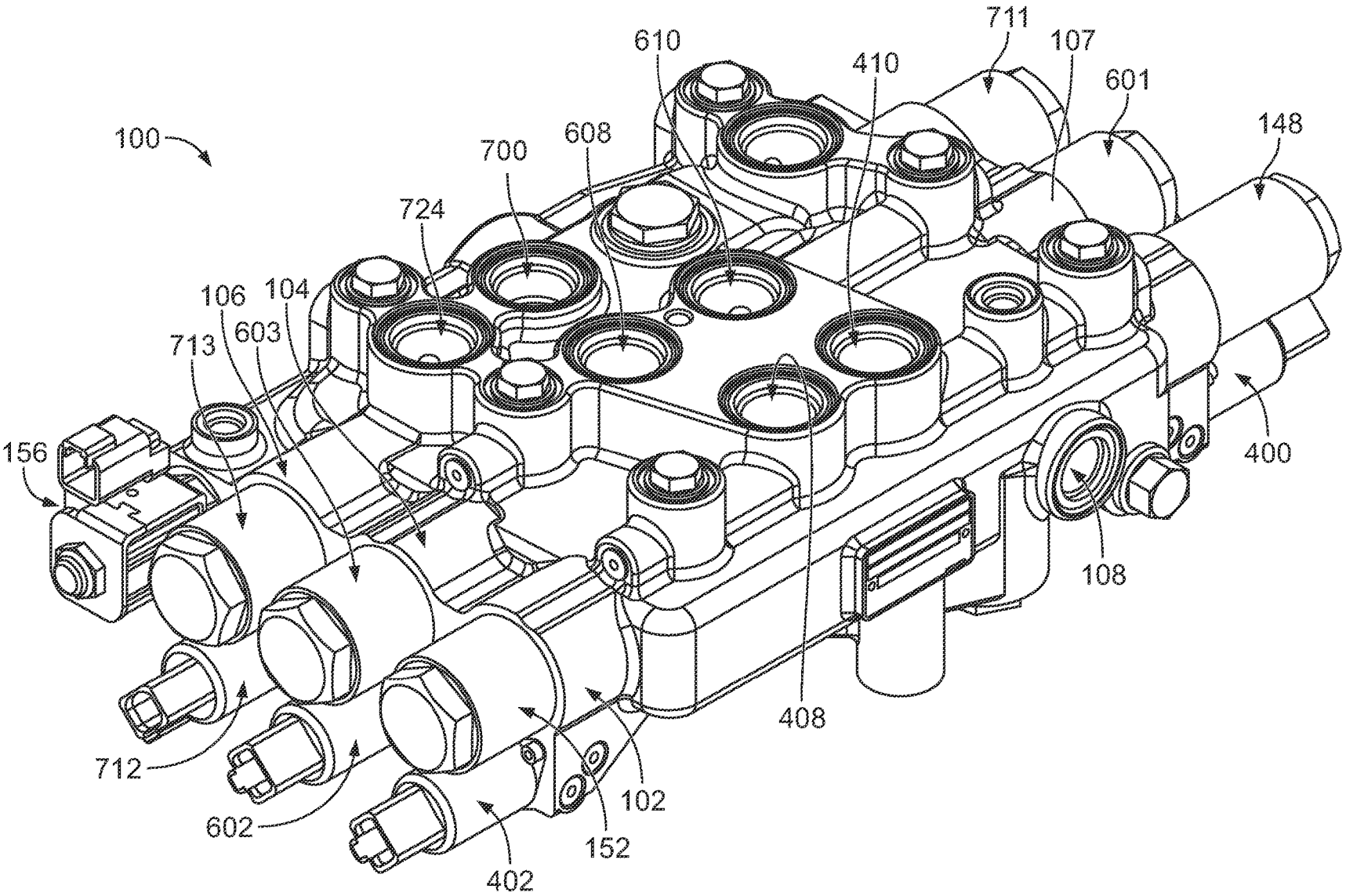
FIG. 1 illustrates a perspective view of a valve assembly of an open-center valve, in accordance with an example implementation.

FIG. 1 illustrates a perspective view of a valve assembly 100 of an open-center valve, in accordance with an example implementation. In the example implementation, the valve assembly 100 includes a valve section 102, a valve section 104, and a valve section 106. The valve sections 102, 104 can configured to control fluid flow to and from primary actuators of a hydraulic machine (e.g., control boom actuator and bucket actuator of a skid steer, respectively), whereas the valve section 106 can be an auxiliary valve section configured to control fluid flow to an auxiliary actuator of the hydraulic machine (e.g., pin-disconnect actuator, differential-lock actuator, etc.).

Although three valve sections are illustrated, it should be understood that more of fewer sections can be used. Further, in the example implementation of FIG. 1, the valve sections 102, 104, and 106 integrated into a single block (e.g., a monoblock) or valve housing 107 comprising a single unitary casting. In other example implementations, the valve sections 102-106 can be configured as separate sections with separate castings, and they can be fastened together via bolts, for instance. As such, the term "valve section" is used herein to represent a "valve portion" in the configuration described herein where the valve is configured as a monoblock, or represent a separate valve section if the valve is configured as a multi-sectional valve including separate sections in an alternative configuration.

Figure 2:
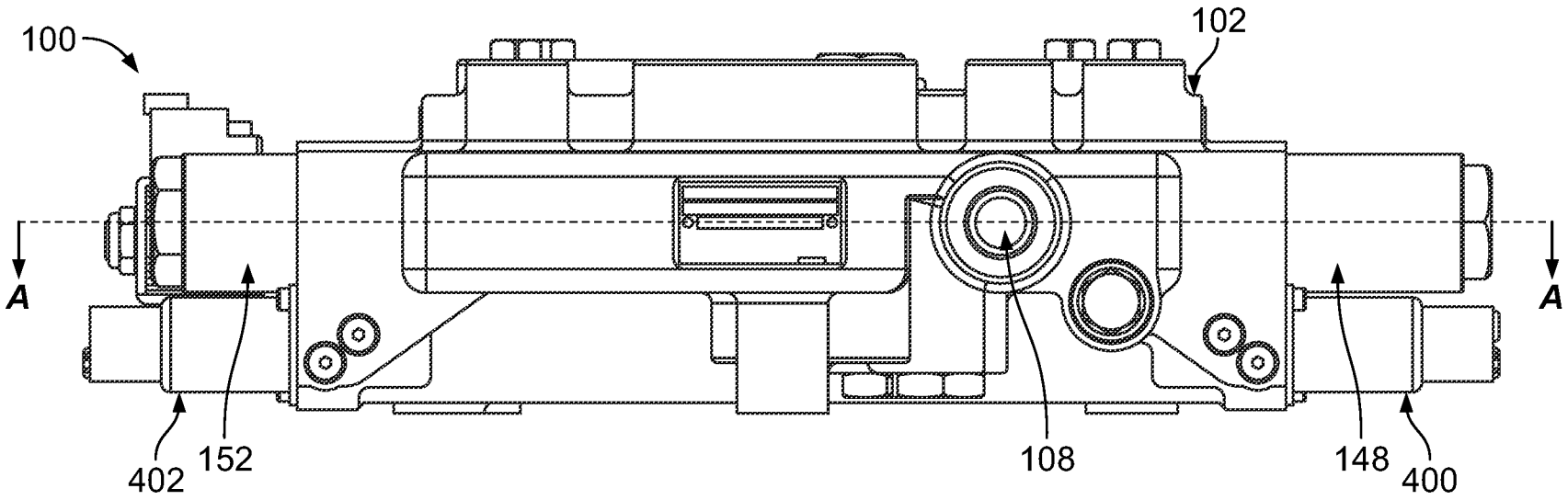
FIG. 2 illustrates a side view of the valve assembly of FIG. 1, in accordance with an example implementation.
Figure 3:
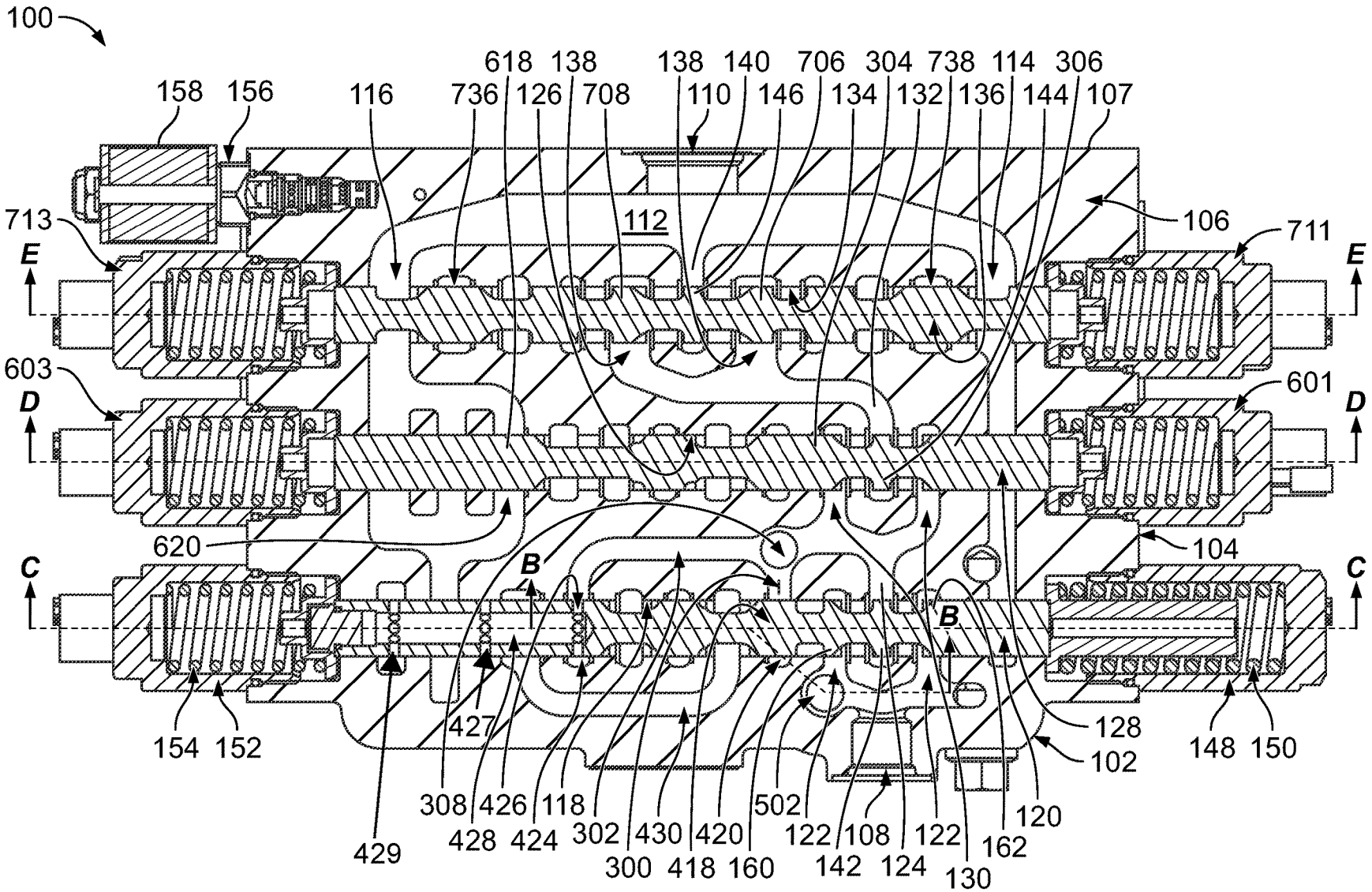
FIG. 3 illustrates a cross section labelled "A-A" in FIG. 2 of the valve assembly, in accordance with an example implementation.

FIG. 2 illustrates a side view of the valve assembly 100, and FIG. 3 illustrates a cross section labelled "A-A" in FIG. 2 of the valve assembly 100, in accordance with an example implementation. As shown in FIGS. 1-3, the valve section 102 operates as an inlet section having a first inlet port 108 that is configured to be fluidly coupled to a primary or first source of fluid such as a pump, an accumulator, etc.

The valve section 106 of the valve housing 107 can include an outlet port 110 that is configured to be fluidly coupled to a tank or reservoir having low pressure fluid. As shown in FIG. 3, the outlet port 110 is fluidly coupled to exhaust or return fluid passage comprising a bight portion 112 connecting with a first transverse leg portion 114 and a second transverse leg portion 116 that traverse the valve housing 107 and located at opposite sides of the valve sections 102-106.

Referring to FIG. 3, the valve section 102 includes a longitudinal bore 118 configured to receive a spool 120 that is axially-movable in the longitudinal bore 118. The valve section 102 also includes an open-center passage intercepting the longitudinal bore 118 and including a double- or dual-wing passage 122 straddling a center passage 124. The open-center passage, and specifically the dual-wing passage 122, is fluidly coupled to the first inlet port 108. The term "dual-wing" is used herein to indicate that a passage (e.g., the passage from the first inlet port 108) branches into two legs or branches referred to as dual-wing passage.

The valve section 104 similarly includes a longitudinal bore 126 configured to receive a spool 128 that is axially-movable in the longitudinal bore 126. The valve section 104 also includes an open-center passage intercepting the longitudinal bore 126 and including a dual-wing passage 130 straddling a center passage 132. The dual-wing passage 130 is fluidly coupled to the center passage 124 of the valve section 102, which is fluidly coupled to the first inlet port 108.

The valve section 106 similarly includes a longitudinal bore 134 configured to receive a spool 136 that is axially-movable in the longitudinal bore 134. The valve section 106 also includes an open-center passage intercepting the longitudinal bore 134 and including a dual-wing passage 138 straddling a center passage 140. The dual-wing passage 138 is fluidly coupled to the center passage 132 of the valve section 104. Further, the center passage 140 is fluidly coupled to the bight portion 112 of the return fluid passage, and is thus fluidly coupled to the outlet port 110.

Each of the spools 120, 128, 136 varies in diameter along its length to form lands of variable diameters capable of selectively interconnecting the various passages respectively intercepting the longitudinal bores 118, 126, 134 to control flow of fluid to and from the actuator. The spool 120 includes a land 142 that is thinner in width than a width of the center passage 124, thereby allowing fluid to flow thereabout from the dual-wing passage 122 to the center passage 124 when the spool 120 is in a neutral (e.g., unactuated or centered) position.

Similarly, the spool 128 includes a land 144 that is thinner in width than a width of the center passage 132, thereby allowing fluid to flow thereabout from the dual-wing passage 130 to the center passage 132 when the spool 128 is in a neutral position. Also, the spool 136 includes a land 146 that is thinner in width than a width of the center passage 140, thereby allowing fluid to flow thereabout from the dual-wing passage 138 to the center passage 140 when the spool 136 is in a neutral position.

Thus, when the spools 120, 128, 136 are in a neutral position as shown in FIG. 3, the open-center passages are unblocked. As such, fluid received at the first inlet port 108 flows through the dual-wing passage 122, around the land 142 of the spool 120 through the center passage 124, then through the dual-wing passage 130, around the land 144 of the spool 128 through the center passage 132, and then through the dual-wing passage 138, around the land 146 of the spool 136 through the center passage 140 to the bight portion 112 then to the outlet port 110.

The spools 120, 128, 136 can be maintained in the neutral position via biasing springs. For instance, the valve assembly 100 can include a first end cap 148 coupled to the valve section 102 at a first end of the spool 120. The first end cap 148 houses a first spring 150 configured to bias the spool 120 in a first axial direction (e.g., to the left in FIG. 3). The valve assembly 100 can similarly include a second end cap 152 coupled to the valve section 102 at a second end of the spool 120, opposite the first end. The second end cap 152 houses a second spring 154 configured to bias the spool 120 in a second axial direction (e.g., to the right in FIG. 3).

With this configuration, the springs 150, 154 bias the spool 120 in opposite directions and therefore maintain the spool 120 in a centered or neutral position that renders the open-center flow path open, until the valve section 102 is actuated to shift the spool 120. The valve sections 104, 106 can include similar caps and springs that operate to maintain their respective spools 128, 136 in a neutral position until actuated.

The spools 120, 128, 136 can be shifted via electric (e.g., solenoid), manual, or fluidic actuation mechanisms. In the example implementation described herein, a solenoid actuator (as an example electric actuator) is used; however, it should be understood that other actuator mechanisms can be used.

In an example, the valve assembly 100 can include a pilot-enable valve 156 as shown in FIGS. 1 and 3. The pilot-enable valve 156 can, for example, be configured to receive a fluid signal from the first inlet port 108 via drilled fluid passages not shown in the Figure. The pilot-enable valve 156 is configured to either provide a pilot signal to the pilot valves that actuate the spools 120, 128, 136 or block the fluid signal based on actuation state of the pilot-enable valve 156.

The pilot-enable valve 156 can be actuated by a solenoid 158. When the pilot-enable valve 156 is unactuated (e.g., no electric signal is provided to the solenoid 158), the pilot-enable valve 156 operates in a pilot-disable state and is configured to block the fluid signal. When the pilot-enable valve 156 is actuated (e.g., an electric signal is provided to the solenoid 158), the pilot-enable valve 156 operates in a pilot-enable state where it provides the pilot signal downstream to the pilot valves that actuate the spools 120, 128, 136.

Figure 4:
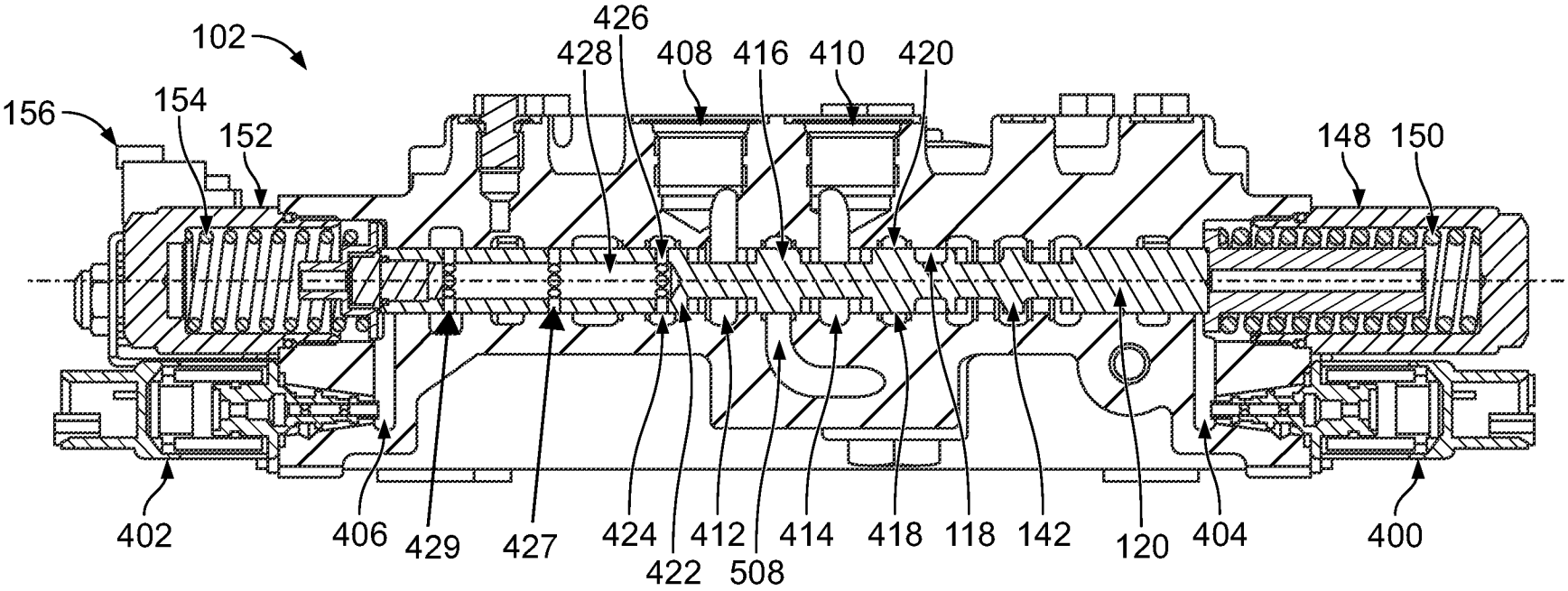
FIG. 4 illustrates a partial cross section labelled "C-C" in FIG. 3 of a valve section, in accordance with an example implementation.
Figure 5:
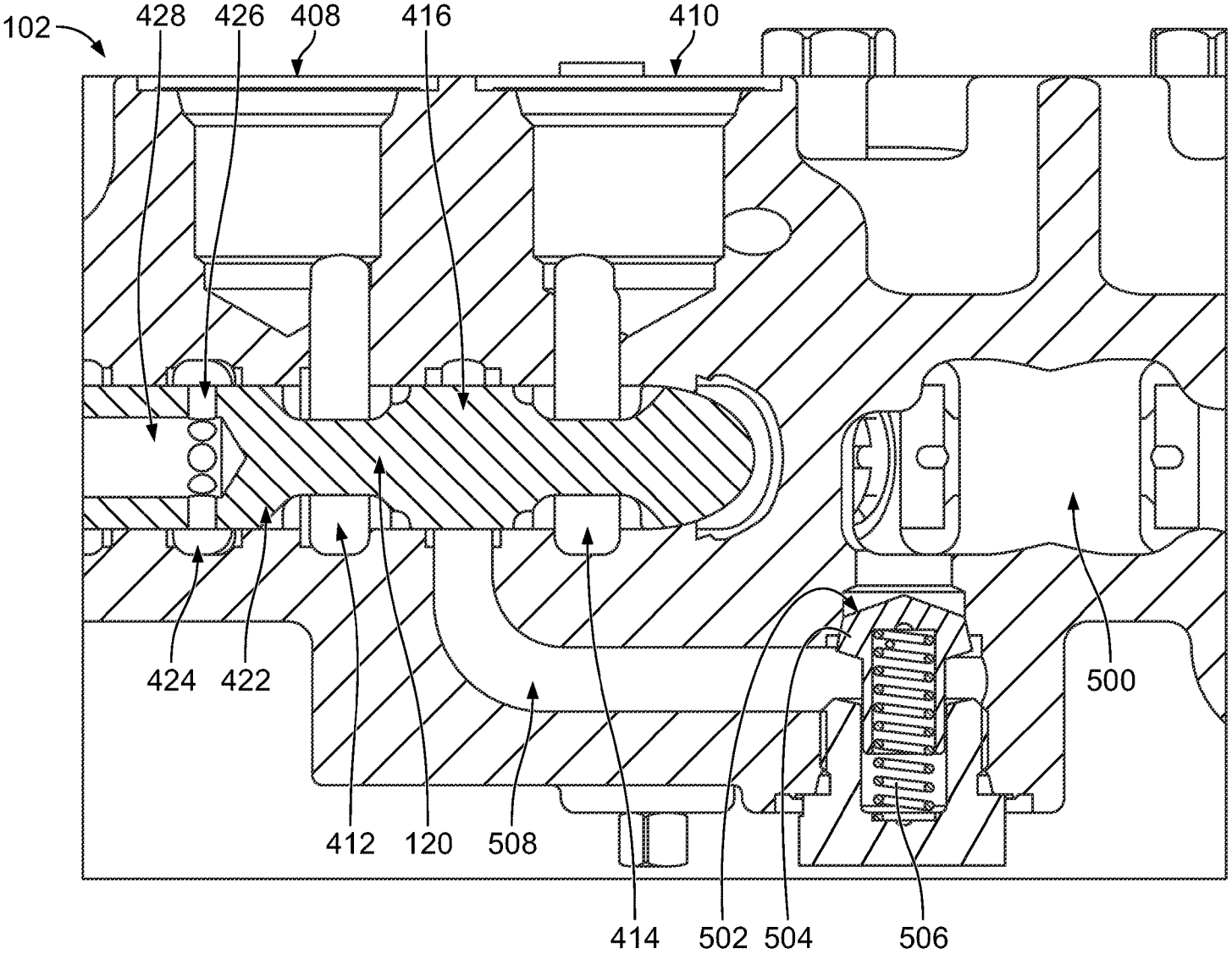
FIG. 5 illustrates a cross section labelled "B-B" in FIG. 3 of a valve section, in accordance with an example implementation.

FIG. 4 illustrates a partial cross section labelled "C-C" in FIG. 3 of the valve section 102, and FIG. 5 illustrates a cross section labelled "B-B" in FIG. 3 of the valve section 102, in accordance with an example implementation. Referring to FIG. 4, the valve section 102 can include a first pilot valve 400 and a second pilot valve 402 that are solenoid-operated and can be used to actuate or move the spool 120 in the longitudinal bore 118.

When the pilot-enable valve 156 is actuated, the pilot valves 400, 402 are configured to receive a pilot fluid signal from the pilot-enable valve 156. When either of the pilot valves 400, 402 is actuated by an electric signal, the actuated pilot valve provides the pilot fluid signal or enables communication of the pilot fluid signal to a respective end cap of the end caps 148, 152. The fluid in the end cap 148 or 152 applies a force on the spool 120 in a respective axial direction causing the spool 120 to shift in the longitudinal bore 118.

In particular, referring to FIG. 4, if the pilot valve 400 is actuated, the pilot valve 400 reduces a pressure level of the pilot fluid signal received from the pilot-enable valve 156 (e.g., from 600 psi to a pressure level value between 200 psi and 460 psi proportional to an electric command signal to the pilot valve 400) and allows the pilot fluid signal to flow through pilot passage 404 to a chamber within the end cap 148 (e.g., the chamber that houses the spring 150). The pilot fluid then applies a force on spool 120 to move the spool 120 axially in a first direction (e.g., to the left in FIG. 4).

On the other hand, if the pilot valve 402 is actuated, the pilot valve 402 reduces a pressure level of the pilot fluid signal received from the pilot-enable valve 156 (e.g., from 600 psi to a pressure level value between 200 psi and 460 psi proportional to an electric command signal to the pilot valve 402) and allows the pilot fluid signal to flow through pilot passage 406 to a chamber within the end cap 152 (e.g., the chamber that houses the spring 154). The pilot fluid then applies a force on the spool 120 to move the spool 120 axially in a second direction (e.g., to the right in FIG. 4), opposite the first direction.

Upon shifting the spool 120 to move its associated actuator (e.g., hydraulic cylinder or motor fluidly coupled to the valve section 102), the shifted spool restricts or blocks fluid flow through the open-center passage (e.g., the dual-wing passage 122 and the center passage 124). In particular, referring back to FIG. 3, if the spool 120 is shifted to the right (by actuating the pilot valve 402), the land 142 and land 160 of the spool 120 restrict or block flow from the dual-wing passage 122 to the center passage 124. If the spool 120 is shifted to the left, the land 142 and land 162 of the spool 120 similarly restrict or block flow from the dual-wing passage 122 to the center passage 124.

Referring to FIGS. 3 and 5 together, as fluid is restricted or blocked from flowing through the open-center passage and fluid is diverted to a passage 500 formed in the valve housing 107 (i.e., formed in the valve section 102). As shown in FIG. 5, the valve section 102 includes a check valve 502 having a poppet 504 biased by a spring 506.

The check valve 502 initially blocks fluid flow from the passage 500, thereby allowing pressure build-up in the passage 500 (i.e., allow pressure level of fluid in the passage 500 to increase). When pressure level in the passage 500 exceeds a threshold pressure value such that the fluid force applied by fluid in the passage 500 to the poppet 504 overcomes the biasing force of the spring 506, the poppet 504 is unseated (e.g., moves downward in FIG. 5) and opens a fluid path from the passage 500 to supply passage 508. A portion of the supply passage 508 is shown in the cross section C-C of FIG. 4.

Referring to FIGS. 4 and 5 together, the valve section 102 includes a first workport 408 and a second workport 410. The workports 408, 410 are configured to be fluidly coupled to chambers of a hydraulic actuator (e.g., to the head and rod sides of a hydraulic actuator cylinder). The valve section 102 further includes a first workport passage 412 that is fluidly coupled to the first workport 408 and includes a second workport passage 414 that is fluidly coupled to the second workport 410. The spool 120 has land 416 that can block fluid in the supply passage 508 when the spool 120 is in the neutral, unactuated position.

When the spool 120 is shifted to the extent that the land 416 no longer blocks the supply passage 508, fluid can flow from the supply passage 508 to either the workport passage 412 or the workport passage 414 based on direction of motion of the spool 120. For instance, if the spool 120 moves to the right relative to the neutral position, fluid in the supply passage 508 can flow to the workport passage 412, then to the workport 408 and to a first chamber of an actuator coupled to the valve section 102. Fluid discharged from an opposite or second chamber of the actuator flows to the workport 410, then through workport passage 414.

As the spool 120 moves to the right, land 418 of the spool 120 can expose or open a flow path to a return cavity 420 from the workport passage 414. Referring back to FIG. 3, fluid in the return cavity 420 can flow through passage 300 and join fluid in the dual-wing passage 130 of the valve section 104.

On the other hand, if the spool 120 moves to the left relative to the neutral position in FIGS. 3-5, fluid in the supply passage 508 flows to the workport passage 414, then to the workport 410. As mentioned above, the workport 410 is configured to be fluidly coupled to the second chamber of the actuator controlled by the valve section 102. Fluid discharged from the first chamber of the actuator flows to the workport 408, then through the workport passage 412.

Referring to FIG. 4, as the spool 120 moves to the left, land 422 of the spool 120 can expose or open a flow path to a return cavity 424 from the workport passage 412. Fluid in the return cavity 424 can then flow through a plurality of radial cross-holes 426 to an internal chamber 428 formed within the spool 120. Referring back to FIG. 3, fluid in the return cavity 424 can flow through passage 302 and join fluid in the dual-wing passage 130 of the valve section 104.

Notably, the valve assembly 100 is also configured to operate in a "float" mode, where both the workport 408 and the workport 410 are fluidly coupled to the reservoir or tank. Particularly, if the spool 120 is shifted all the way to the right in FIGS. 3-4, the radial cross-holes 426 fluidly couple the workport passage 412 (and the workport 408) to the internal chamber 428. In addition, radial cross-holes 427 become exposed to fluid in loop fluid passage 430, which is fluidly coupled to the workport passage 414. Thus, the workport passage 414 (and the workport 410) is also fluidly coupled to the internal chamber 428 via the radial cross-holes 427. Further, radial cross-holes 429 become exposed to the second transverse leg portion 116 of the return fluid passage, which is coupled to the outlet port 110. As such, the internal chamber 428 (which is fluidly coupled to both the workport 408 and the workport 410 via the radial cross-holes 426 and the radial cross-holes 427 respectively) is fluidly coupled to the outlet port 110, which is configured to be fluidly coupled to the tank.

The valve section 104 is configured to operate in a similar manner to the valve section 102 as described above in FIGS. 3-5. However, in the example implementation described herein, the spool 128 is configured to allow for flow regeneration. This configuration allows for driving the actuator coupled to the valve section 104 at a higher speed compared to another standard spool configuration (e.g., the configuration of the valve section 102 and the spool 120) wherein regeneration is not allowed.

Figure 6:
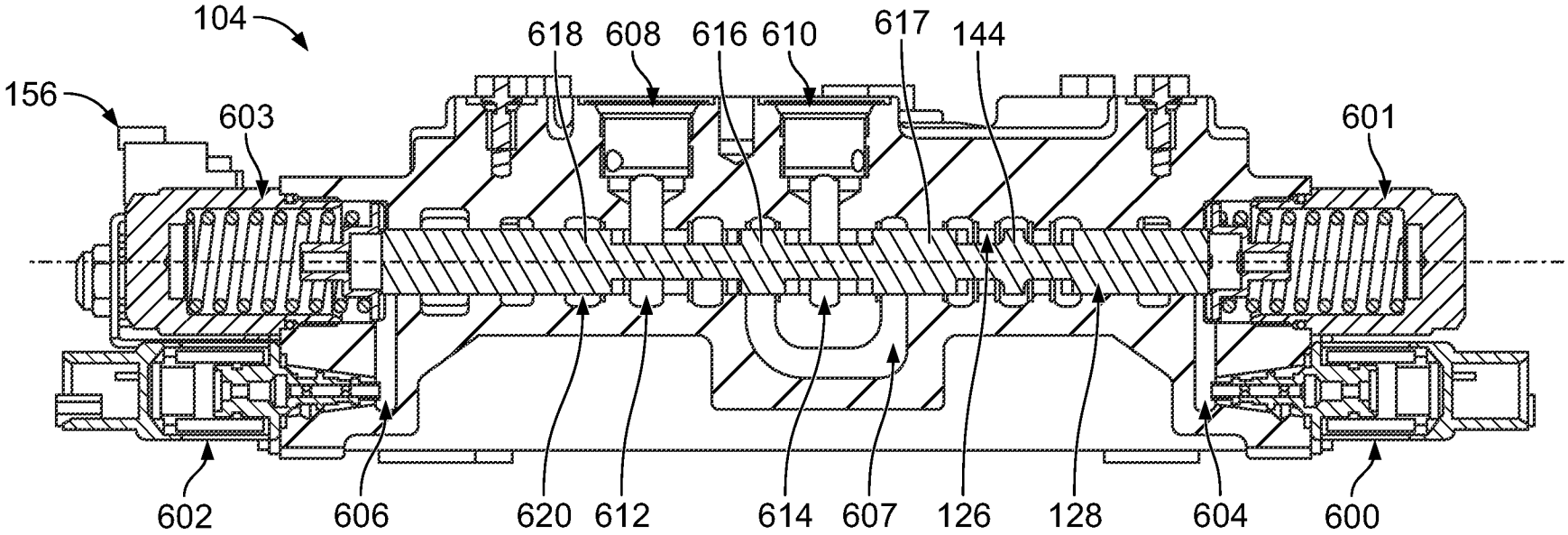
FIG. 6 illustrates a cross section labelled "D-D" in FIG. 3 of a valve section, in accordance with an example implementation.

FIG. 6 illustrates a cross section labelled "D-D" in FIG. 3 of the valve section 104, in accordance with an example implementation. The valve section 104 can include a first pilot valve 600 and a second pilot valve 602 that are solenoid-operated and can be used to actuate or move the spool 128 in the longitudinal bore 126.

When the pilot-enable valve 156 is actuated, the pilot valves 600, 602 are configured to receive a pilot fluid signal from the pilot-enable valve 156, such that when either of the pilot valves 600, 602 is actuated by an electric signal, the actuated pilot valve provides the pilot fluid signal or enables communication of the pilot fluid signal to a respective end cap of the end caps 601, 603. The fluid in the end cap 601 or 603 applies a force on the spool 128 in a respective axial direction causing the spool 128 to shift in the longitudinal bore 126.

In particular, referring to FIG. 6, if the pilot valve 600 is actuated, the pilot valve 600 reduces a pressure level of the pilot fluid signal received from the pilot-enable valve 156 (e.g., from 600 psi to a pressure level value between 200 psi and 460 psi proportional to an electric command signal to the pilot valve 600) and allows the pilot fluid signal to flow through pilot passage 604 to a chamber within the end cap 601. The pilot fluid then applies a force on spool 128 to move the spool 128 axially in a first direction (e.g., to the left in FIG. 6).

On the other hand, if the pilot valve 602 is actuated, the pilot valve 602 reduces a pressure level of the pilot fluid signal received from the pilot-enable valve 156 (e.g., from 600 psi to a pressure level value between 200 psi and 460 psi proportional to an electric command signal to the pilot valve 602) and allows the pilot fluid signal to flow through pilot passage 606 to a chamber within the end cap 603. The pilot fluid then applies a force on the spool 128 to move the spool 128 axially in a second direction (e.g., to the right in FIG. 6), opposite the first direction.

Similar to operation of the valve section 102 described above, upon shifting the spool 128 to move its associated actuator (e.g., hydraulic cylinder or motor fluidly coupled to the valve section 104), the shifted spool restricts or blocks fluid flow through the open-center passage (e.g., the dual-wing passage 130 and the center passage 132 shown in FIG. 3). In particular, referring back to FIG. 3, if the spool 128 is shifted to the right (by actuating the pilot valve 602), the land 144 and land 304 restrict or block flow from the dual-wing passage 130 to the center passage 132. If the spool 128 is shifted to the left, the land 144 and land 306 restrict or block flow from the dual-wing passage 130 to the center passage 132.

Referring to FIGS. 3 and 6 together, as fluid is restricted or blocked from flowing through the open-center passage of the valve section 104, fluid can be diverted to passage blocked by a check valve 308. The check valve 308 operates similar to the check valve 502 of the valve section 102.

Particularly, the check valve 308 may initially block fluid flow to allow pressure in the passages 130, 300, 302 to increase. When pressure level exceeds a threshold pressure value such that the fluid force applied by fluid to a poppet of the check valve 308 overcomes a biasing force of its spring, the poppet is unseated and opens a fluid path to a supply passage 607 shown in FIG. 6 as a looped passage.

Referring to FIG. 6, the valve section 104 includes a first workport 608 and a second workport 610. The workports 608, 610 are configured to be fluidly coupled to chambers of a hydraulic actuator (e.g., to the head and rod sides of a hydraulic actuator cylinder). The valve section 104 further includes a first workport passage 612 that is fluidly coupled to the first workport 608 and includes a second workport passage 614 that is fluidly coupled to the second workport 610. The spool 128 has land 616 and land 617 that can block fluid in the supply passage 607 when the spool 128 is in the neutral, unactuated position.

When the spool 128 is shifted to the right in FIG. 6 to the extent that the lands 616, 617 no longer block the supply passage 607, fluid can flow from the supply passage 607 to the workport passage 612 then to the workport 608 and to a first chamber of an actuator coupled to the valve section 104. At the same time, fluid discharged from an opposite or second chamber of the actuator flows to the workport 610, through workport passage 614, to the supply passage 607, and then joins the fluid being provided to the workport 608.

This mode of operation where fluid returning from one chamber of the actuator is being provided to the other chamber of the actuator can be referred to as regeneration or regenerative mode. In this mode, fluid returning from the actuator does not flow back to a reservoir or tank coupled to the valve assembly 100, but is rather provided to the other chamber of the actuator. Since the source of fluid flow (e.g., the pump) that provides high pressure fluid to the first inlet port 108 is fluidly coupled to both workports 608, 610, this mode of operation can be referred to as high-side regeneration mode indicating regeneration of high pressure fluid.

On the other hand, if the spool 128 moves to the left relative to the neutral position in FIGS. 3, 6, fluid in the supply passage 607 flows to the workport passage 614 across the land 616, then to the workport 610. However, the land 616 blocks fluid flow from the supply passage 607 to the workport passage 612. As mentioned above, the workport 610 is configured to be fluidly coupled to the second chamber of the actuator controlled by the valve section 104. Fluid discharged from the first chamber of the actuator flows to the workport 608, then through the workport passage 612.

As the spool 128 moves to the left, land 618 of the spool 128 can expose or open a flow path to a return cavity 620 from the workport passage 612. Referring back to FIG. 3, fluid in the return cavity 620 can then join fluid in the second transverse leg portion 116 of the return fluid passage coupled to the outlet port 110 (which can be fluidly coupled to a reservoir or tank).

As mentioned above, the valve assembly 100 can include the valve section 106 configured to drive an auxiliary actuator of a hydraulic machine. The valve section 106 is configured to operate in a similar manner to the valve sections 102, 104. Additionally, the valve section 106 is configured to allow a second fluid flow source to be coupled to the valve assembly 100 to provide additional fluid flow to the auxiliary actuator to drive it a higher speed.

Figure 7:
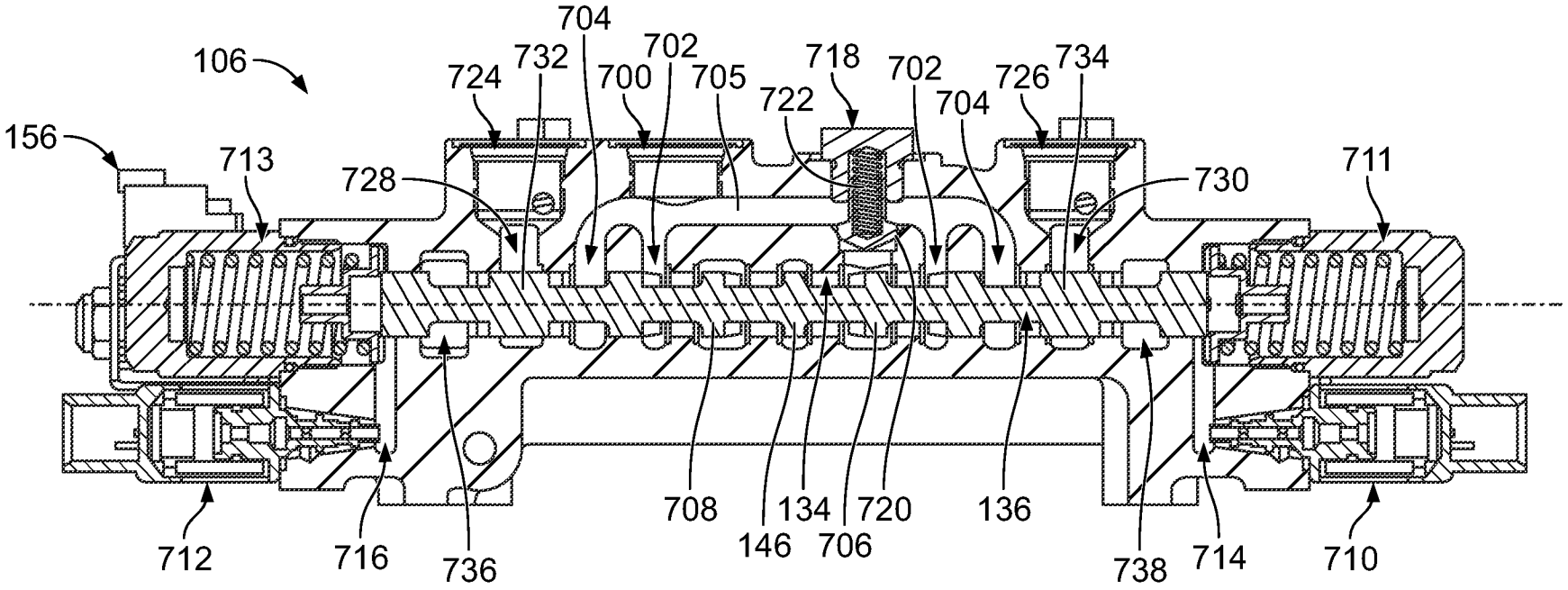
FIG. 7 illustrates a cross section labelled "E-E" in FIG. 3 of a valve section, in accordance with an example implementation.
Figure 8:
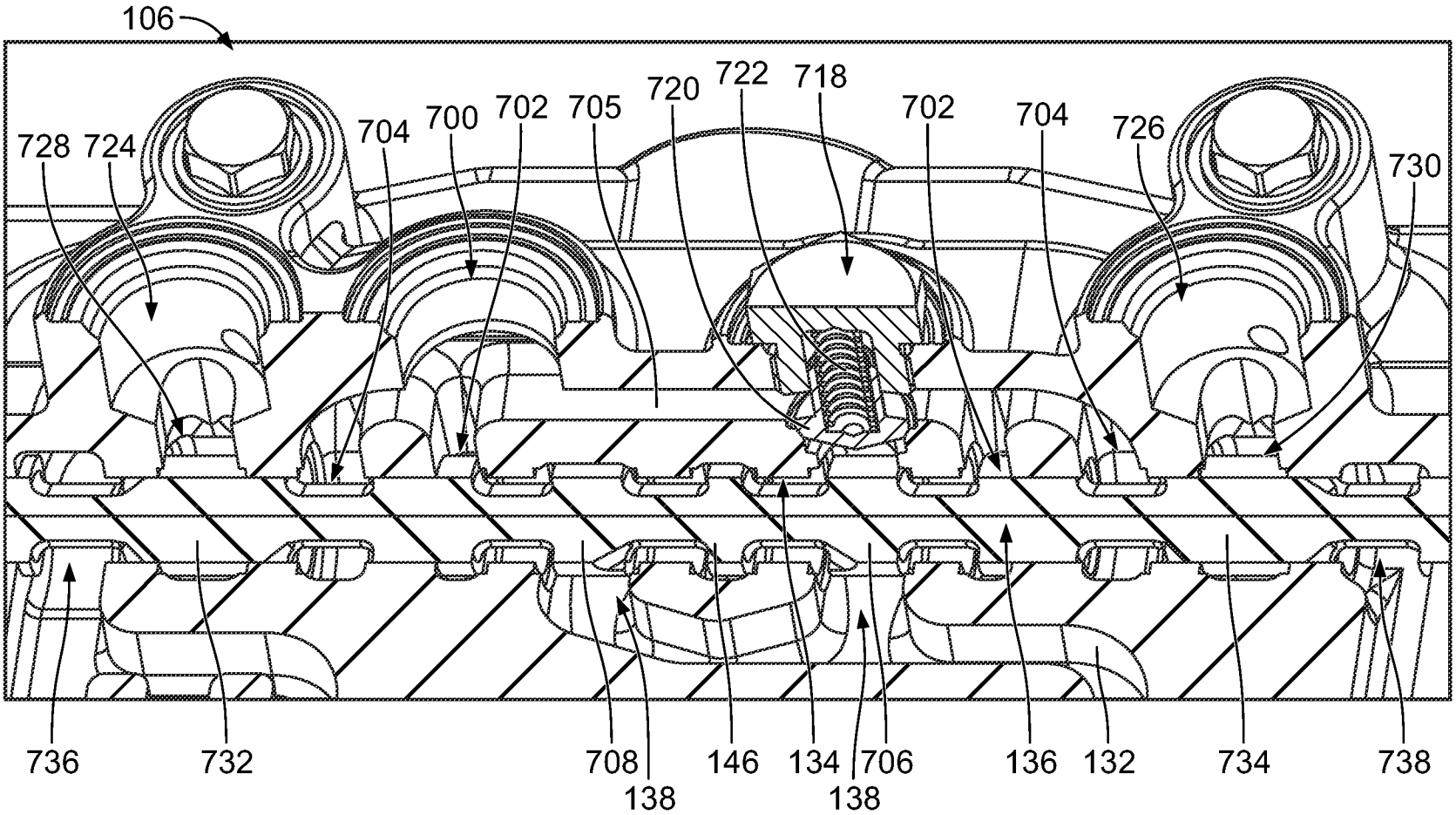
FIG. 8 illustrates a partial cutaway view of a valve section, in accordance with an example implementation.

FIG. 7 illustrates a cross section labelled "E-E" in FIG. 3 of the valve section 106, and FIG. 8 illustrate a partial cutaway view of the valve section 106, in accordance with an example implementation. The cutaway view of FIG. 8 illustrates features of the cross-sectional view in FIG. 7 and the cross-sectional view of FIG. 3 to illustrate configuration of the flow passages of the valve section 106. FIGS. 7 and 8 are described together.

The valve section 106 includes a second inlet port 700 configured to be fluidly coupled to, and receive additional fluid flow from, a second source of fluid (e.g., a second pump). The valve section 106 further includes two dual-wing passages fluidly coupled to the second inlet port 700. Particularly, the valve section 106 includes a first dual-wing passage 702 and a second dual-wing passage 704 that are fluidly coupled to the second inlet port 700. The first dual-wing passage 702 and the second dual-wing passage 704 share, or have a common bight portion 705.

The two legs or branches of first dual-wing passage 702 are interposed between the respective two branches of the second dual-wing passage 704. As such the first dual-wing passage 702 can be referred to as an inner dual-wing passage, whereas the second dual-wing passage 704 can be referred to as an outer dual-wing passage. Further, as shown in FIG. 8, the two branches of the dual-wing passage 138 are interposed between branches of the first dual-wing passage 702.

Referring to FIGS. 3, 7, and 8, when the spool 128 is in a neutral position, fluid flowing through the dual-wing passage 138 is allowed to flow about land 706, land 708, and the land 146 to the center passage 140, and then through the bight portion 112 to the outlet port 110. When the spool 136 is in a neutral position depicted in FIGS. 3, 7, 8, fluid received at the second inlet port 700 flows through the first dual-wing passage 702 (the inner dual-wing passage), joins the fluid received from the dual-wing passage 138, flows around lands 706, 708, and 146, and then flows through the center passage 140 to the outlet port 110. When the spool 136 is shifted, however, the fluid flow from the second source (through the second inlet port 700) joins fluid flow from the first source (through the first inlet port 108) and is provided to the auxiliary actuator coupled to the valve section 106 as described below.

The valve section 106 can include a first pilot valve 710 and a second pilot valve 712 that are solenoid-operated and can be used to actuate or move the spool 136 in the longitudinal bore 134. When the pilot-enable valve 156 is actuated, the pilot valves 710, 712 are configured to receive a pilot fluid signal from the pilot-enable valve 156, such that when either of the pilot valves 710, 712 is actuated by an electric signal, the actuated pilot valve provides the pilot fluid signal or enables communication of the pilot fluid signal to a respective end cap of the end caps 711, 713. The fluid in the end cap 711 or 713 can apply a force on the spool 136 in a respective axial direction causing the spool 136 to shift in the longitudinal bore 134.

In particular, referring to FIG. 7, if the pilot valve 710 is actuated, the pilot valve 710 reduces a pressure level of the pilot fluid signal received from the pilot-enable valve 156 and allows the pilot fluid signal to flow through pilot passage 714 to a chamber within the end cap 711. The pilot fluid then applies a force on spool 136 to move the spool 136 axially in a first direction (e.g., to the left in FIG. 7).

On the other hand, if the pilot valve 712 is actuated, the pilot valve 712 reduces a pressure level of the pilot fluid signal received from the pilot-enable valve 156 and allows the pilot fluid signal to flow through pilot passage 716 to a chamber within the end cap 713. The pilot fluid then applies a force on the spool 136 to move the spool 136 axially in a second direction (e.g., to the right in FIG. 7), opposite the first direction.

Upon shifting the spool 136 to move its associated actuator (e.g., hydraulic cylinder or motor fluidly coupled to the valve section 106), the shifted spool restricts or blocks the combined fluid flow of the dual-wing passage 138 and the dual-wing passage 702 from flowing to the center passage 140 shown in FIG. 3. In particular, referring back to FIGS. 3 and 7 together, if the spool 136 is shifted to the right (by actuating the pilot valve 712), the lands 708, 146 restrict or block flow from the dual-wing passage 138 to the center passage 140. Similarly, if the spool 136 is shifted to the left (by actuating the pilot valve 710), the lands 706, 146 restrict or block flow from the dual-wing passage 138 to the center passage 140. Whether the spool 136 shifts to the left or to the right, the lands 706, 708 block fluid in the dual-wing passage 702 from flowing to the center passage 140.

Also, whether the spool 136 shifts to the left or to the right, fluid from the dual-wing passage 138 (from the first inlet port 108) is diverted to flow around the land 706 toward a check valve 718 having a poppet 720 biased by a spring 722. The check valve 718 is configured to block fluid by the poppet 720 as long as pressure level of fluid diverted around the land 706 is not sufficient to overcome the biasing force of the spring 722. As fluid is being blocked from flowing to the center passage 140 by the lands 146, 706, 708 and is being blocked by the check valve 718, pressure level increases.

When pressure level exceeds a threshold pressure value such that the fluid force applied by fluid to the poppet 720 of the check valve 718 overcomes the biasing force of the spring 722, the poppet 720 is unseated and opens a fluid path for fluid from the dual-wing passage 138 to join fluid in the dual-wing passage 704 from the second inlet port 700.

Referring to FIGS. 7-8, the valve section 106 includes a first workport 724 and a second workport 726. The workports 724, 726 can be fluidly coupled to chambers of an auxiliary hydraulic actuator (e.g., to the head and rod sides of a hydraulic actuator cylinder), for example. The valve section 106 further includes a first workport passage 728 that is fluidly coupled to the first workport 724 and includes a second workport passage 730 that is fluidly coupled to the second workport 726.

All three dual-wing passages (the dual-wing passage 138, the dual-wing passage 702, and the dual-wing passage 704) are interposed between the first workport passage 728 and the second workport passage 730). Further, the valve housing 107 is configured such that branches of the three dual-wing passages (the dual-wing passage 138, the dual-wing passage 702, and the dual-wing passage 704) are interposed between the transverse leg portions 114, 116 of the return fluid passage.

The spool 136 has land 732 that can block fluid in the dual-wing passage 704 from flowing to the workport passage 728 when the spool 136 is in the neutral, unactuated position. Similarly, the spool 136 has land 734 that can block fluid in the dual-wing passage 704 from flowing to the workport passage 730 when the spool 136 is in the neutral, unactuated position.

When the pilot valve 712 is actuated, the spool 136 can be shifted to the right in FIG. 7 to the extent that the land 734 no longer blocks the workport passage 730 and the land 732 no longer blocks the workport passage 728. As such, the combined fluid flow from the two sources of fluid can flow from the dual-wing passage 704 through the workport passage 730 then to the workport 726 and to the auxiliary actuator coupled to the valve section 106. At the same time, fluid discharged from the actuator flows to the workport 724, through workport passage 728, to a return cavity 736, which is fluidly coupled to the second transverse leg portion 116 of the return fluid passage coupled to the outlet port 110 (see FIG. 3).

On the other hand, when the pilot valve 710 is actuated, the spool 136 can be shifted to the left in FIG. 7 to the extent that the land 732 no longer blocks the workport passage 728 and the land 734 no longer blocks the workport passage 730. As such, the combined fluid flow from the two sources of fluid can flow from the dual-wing passage 704 through the workport passage 728 then to the workport 724 and to the auxiliary actuator coupled to the valve section 106. At the same time, fluid discharged from the actuator flows to the workport 726, through workport passage 730, to a return cavity 738, which is fluidly coupled to the first transverse leg portion 114 of the return fluid passage coupled to the outlet port 110 as shown in FIG. 3.

Thus, the configuration of the valve section 106 enables directly, fluidly coupling a second source of fluid flow to the valve assembly 100 without having to add an additional section. When the spool 136 is in a neutral position, the configuration of the valve section 106 allows fluid from the second source (received at the second inlet port 700) flowing through the dual-wing passage 702 to be combined with fluid from the first source of fluid (received at the first inlet port 108) flowing through the dual-wing passage 138. The combined fluid is then allowed to flow to the reservoir coupled to the outlet port 110.

The branches of the dual-wing passage 138 are interposed between the branches of the dual-wing passage 702, which in turn are interposed between the branches of the dual-wing passage 704. Such double- or dual-wing configuration of the passages keeps flow forces acting on the spool 136 consistent when shifting the spool 136 to either direction since the geometry is symmetrical.

Further, when the spool 136 is shifted and pressure level in the dual-wing passage 138 increases until it exceeds a threshold value and overcomes the biasing force of the spring 722 of the check valve 718, fluid from the first source is combined with the flow from the second source and is provided to the auxiliary actuator. While the check valve 718 allows fluid from the first source flowing through the dual-wing passage 138 to be combined with the fluid flowing from the second source through the second inlet port 700 and flowing through the bight portion 705, the check valve 718 prevents fluid from the second source to back-flow into the dual-wing passage 138 and the first source.

Another check valve can be used to preclude fluid of the first source from back-flowing into the second source. For example, such a check valve can be disposed external to the valve assembly 100 or at the second inlet port 700.

Figure 9:
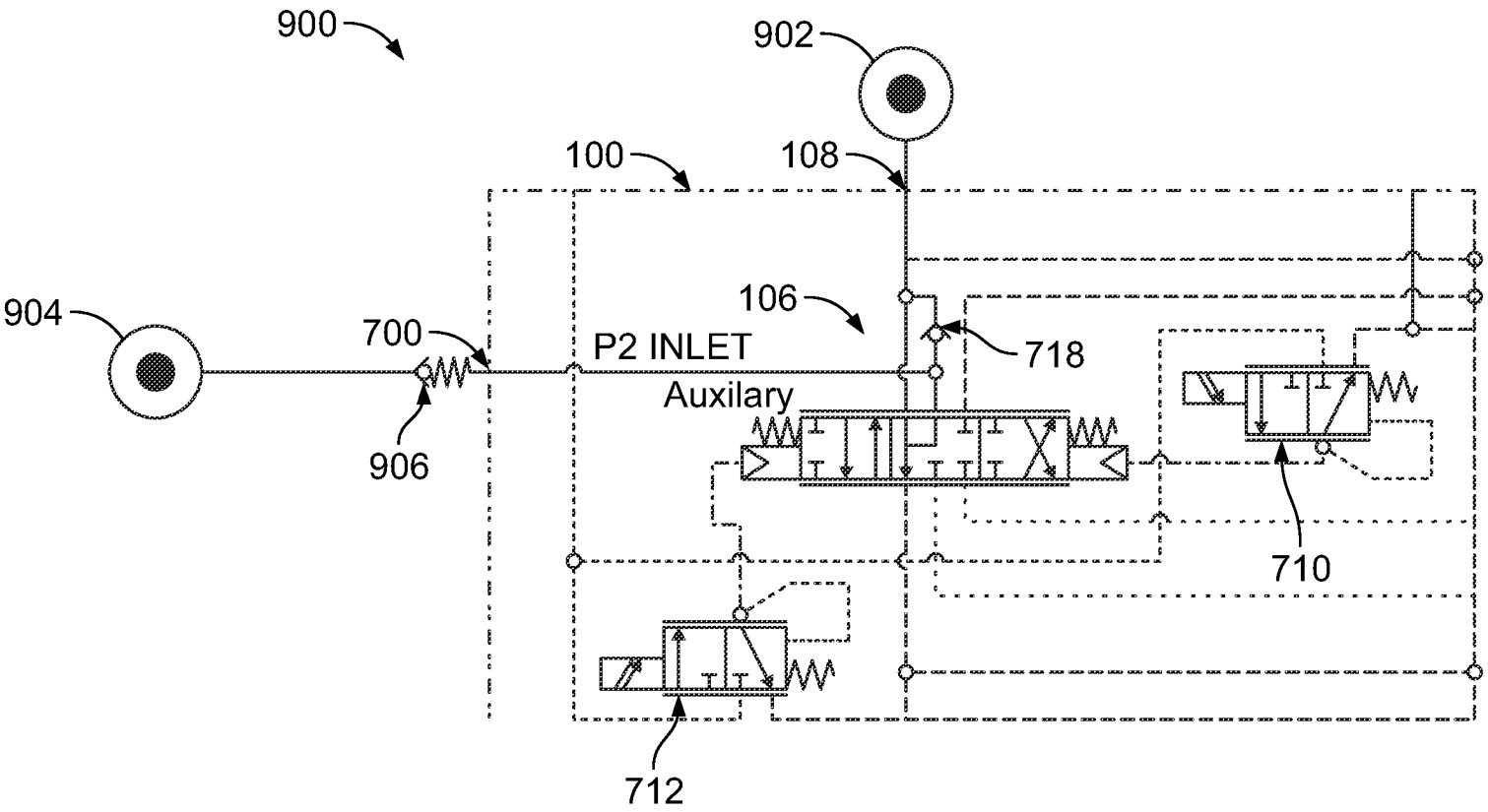
FIG. 9 illustrates a partial hydraulic circuit of a hydraulic system including a valve assembly, in accordance with another example implementation.

FIG. 9 illustrates a partial hydraulic circuit of a hydraulic system 900 including the valve assembly 100, in accordance with an example implementation. The hydraulic circuit in FIG. 9 particularly schematically depicts the valve section 106.

A first source 902 of fluid (e.g., a first pump) provides fluid flow to the first inlet port 108 and a second source 904 of fluid (e.g., a second pump) provides fluid flow to the second inlet port 700. While the check valve 718 precludes fluid from the second source 904 to back-flow into the first source 902, an external check valve 906 can be used to preclude fluid from the first source 902 to back-flow into the second source 904. For instance, the check valve 906 can be disposed in a hydraulic line that couples the second source 904 to the valve assembly 100 (i.e., to the second inlet port 700).

The detailed description above describes various features and operations of the disclosed systems with reference to the accompanying figures. The illustrative implementations described herein are not meant to be limiting. Certain aspects of the disclosed systems can be arranged and combined in a wide variety of different configurations, all of which are contemplated herein.

Further, unless context suggests otherwise, the features illustrated in each of the figures may be used in combination with one another. Thus, the figures should be generally viewed as component aspects of one or more overall implementations, with the understanding that not all illustrated features are necessary for each implementation.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

Further, devices or systems may be used or configured to perform actuators presented in the figures. In some instances, components of the devices and/or systems may be configured to perform the actuators such that the components are actually configured and structured (with hardware and/or software) to enable such performance. In other examples, components of the devices and/or systems may be arranged to be adapted to, capable of, or suited for performing the actuators, such as when operated in a specific manner.

By the term "substantially" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide.

The arrangements described herein are for purposes of example only. As such, those skilled in the art will appreciate that other arrangements and other elements (e.g., machines, interfaces, operations, orders, and groupings of operations, etc.) can be used instead, and some elements may be omitted altogether according to the desired results. Further, many of the elements that are described are functional entities that may be implemented as discrete or distributed components or in conjunction with other components, in any suitable combination and location.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. Also, the terminology used herein is for the purpose of describing particular implementations only, and is not intended to be limiting.

What is claimed is:

1. A valve assembly comprising:

a valve housing comprising: (i) a longitudinal bore, (ii) a first and second workport passages intercepting the longitudinal bore and configured to be fluidly coupled to an actuator, (iii) a first and second return cavities intercepting the longitudinal bore, (iv) a first inlet port configured to be fluidly coupled to a first source of fluid, (v) a second inlet port configured to be fluidly coupled to a second source of fluid, (vi) an outlet port fluidly coupled to the first and second return cavities and configured to be fluidly coupled to a reservoir, (vii) a first dual-wing passage fluidly coupled to the first inlet port, (viii) a second dual-wing passage fluidly coupled to the second inlet port, and (ix) a third dual-wing passage fluidly coupled to the second inlet port; and a spool movable in the longitudinal bore to shift between: (i) a neutral position in which the spool allows fluid flowing through the first dual-wing passage to be combined with fluid flowing through the second dual-wing passage, then flow to the outlet port, and (ii) a shifted position in which the spool allows fluid in the first dual-wing passage to be combined with fluid in the third dual-wing passage, then flow to either the first or second workport passage while connecting the other workport passage to a corresponding return cavity of the first and second return cavities.

2. The valve assembly of claim 1, wherein branches of the first dual-wing passage are interposed between branches of the second dual-wing passage, and wherein the branches of the second dual-wing passage are interposed between branches of the third dual-wing passage.

3. The valve assembly of claim 1, further comprising:

a check valve configured to allow fluid in the first dual-wing passage received from the first source of fluid to flow to the third dual-wing passage having fluid from the second source of fluid, while blocking fluid flow from the third dual-wing passage to the first dual-wing passage.

4. The valve assembly of claim 1, further comprising:

a first pilot valve configured to provide a pilot fluid signal to a first end of the spool when actuated to move the spool in a first direction; and a second pilot valve configured to provide a respective pilot fluid signal to a second end of the spool when actuated to move the spool in a second direction opposite the first direction.

5. The valve assembly of claim 4, further comprising:

a pilot-enable valve, wherein:

when the pilot-enable valve is actuated, the pilot-enable valve provides a fluid signal to the first pilot valve and the second pilot valve, thereby enabling actuation of the spool, and when the pilot-enable valve is unactuated, the pilot-enable valve blocks the fluid signal to disable actuation of the spool.

6. The valve assembly of claim 1, wherein the second dual-wing passage and the third dual-wing passage share a common bight portion that is fluidly coupled to the second inlet port.

7. The valve assembly of claim 1, further comprising:

a first port connected to the first workport passage, wherein the first port is configured to be fluidly coupled to a first chamber of the actuator; and a second port connected to the second workport passage, wherein the second port is configured to be fluidly coupled to a second chamber of the actuator.

8. The valve assembly of claim 1, wherein the first dual-wing passage, the second dual-wing passage, and the third dual-wing passage are interposed between the first workport passage and the second workport passage.

9. A hydraulic system comprising:

a hydraulic actuator having a first chamber and a second chamber;

a first source of fluid;

a second source of fluid;

a reservoir; and a valve assembly comprising:

a valve housing comprising: (i) a longitudinal bore, (ii) a first workport passage fluidly coupled to the first chamber and a second workport passage fluidly coupled to the second chamber, (iii) a first and second return cavities intercepting the longitudinal bore, (iv) a first inlet port fluidly coupled to the first source of fluid, (v) a second inlet port fluidly coupled to the second source of fluid, (vi) an outlet port fluidly coupled to the first and second return cavities and fluidly coupled to the reservoir, (vii) a first dual-wing passage fluidly coupled to the first inlet port, (viii) a second dual-wing passage fluidly coupled to the second inlet port, (ix) a third dual-wing passage fluidly coupled to the second inlet port, and a spool movable in the longitudinal bore to shift between: (i) a neutral position in which the spool allows fluid flowing through the first dual-wing passage to be combined with fluid flowing through the second dual-wing passage, then flow to the outlet port, and (ii) a shifted position in which the spool allows fluid in the first dual-wing passage to be combined with fluid in the third dual-wing passage, then flow to either the first or second workport passage while connecting the other workport passage to a corresponding return cavity of the first and second return cavities.

10. The hydraulic system of claim 9, wherein branches of the first dual-wing passage are interposed between branches of the second dual-wing passage, and wherein the branches of the second dual-wing passage are interposed between branches of the third dual-wing passage.

11. The hydraulic system of claim 9, wherein the valve assembly further comprises:

a check valve configured to allow fluid in the first dual-wing passage received from the first source of fluid to flow to the third dual-wing passage having fluid from the second source of fluid, while blocking fluid flow from the third dual-wing passage to the first dual-wing passage.

12. The hydraulic system of claim 11, wherein the check valve is a first check valve, and wherein the hydraulic system further comprises:

a second check valve configured to allow fluid to flow from the second source of fluid into the second inlet port and the second and third dual-wing passages, while blocking fluid flow from the first dual-wing passage to the second inlet port.

13. The hydraulic system of claim 9, wherein the valve assembly further comprises:

a first pilot valve configured to provide a pilot fluid signal to a first end of the spool when actuated to move the spool in a first direction; and a second pilot valve configured to provide a respective pilot fluid signal to a second end of the spool when actuated to move the spool in a second direction opposite the first direction.

14. The hydraulic system of claim 13, wherein the valve assembly further comprises:

a pilot-enable valve, wherein:

when the pilot-enable valve is actuated, the pilot-enable valve provides a fluid signal to the first pilot valve and the second pilot valve, thereby enabling actuation of the spool, and when the pilot-enable valve is unactuated, the pilot-enable valve blocks the fluid signal to disable actuation of the spool.

15. The hydraulic system of claim 9, wherein the second dual-wing passage and the third dual-wing passage share a common bight portion that is fluidly coupled to the second inlet port.

16. The hydraulic system of claim 9, wherein the valve assembly comprises:

a first port connected to the first workport passage, wherein the first port is configured to be fluidly coupled to the first chamber of the hydraulic actuator; and a second port connected to the second workport passage, wherein the second port is configured to be fluidly coupled to the second chamber of the hydraulic actuator.

17. The hydraulic system of claim 9, wherein the first dual-wing passage, the second dual-wing passage, and the third dual-wing passage are interposed between the first workport passage and the second workport passage.

18. A valve housing comprising:

a plurality of longitudinal bores configured to receive respective spools configured to be axially-movable therein;

a first inlet port configured to be fluidly coupled to a first source of fluid;

a second inlet port configured to be fluidly coupled to a second source of fluid;

an outlet port configured to be fluidly coupled to a reservoir;

a plurality of workports configured to be fluidly coupled to respective hydraulic actuators;

a first dual-wing passage fluidly coupled to the first inlet port;

a second dual-wing passage fluidly coupled to the second inlet port; and a third dual-wing passage fluidly coupled to the second inlet port, wherein the second dual-wing passage and the third dual-wing passage share a common passageway that is fluidly-coupled to the second inlet port, wherein branches of the second dual-wing passage and branches of the third dual-wing passage branch from the common passageway.

19. The valve housing of claim 18, wherein branches of the first dual-wing passage are interposed between the branches of the second dual-wing passage, and wherein the branches of the second dual-wing passage are interposed between the branches of the third dual-wing passage.

20. The valve housing of claim 18, further comprising:

a return fluid passage fluidly coupled to the outlet port and comprising a bight portion connecting with a first transverse leg portion and a second transverse leg portion that traverse the valve housing and located at opposite sides of the valve housing such that branches of the first dual-wing passage, the second dual-wing passage, and the third dual-wing passage are interposed between the first transverse leg portion and the second transverse leg portion.

* * * * *